United States Patent [19]

Cole et al.

[11] 4,447,988

[45] May 15, 1984

[54] GARAGE DOOR WEATHER SEAL

[75] Inventors: Richard H. Cole; Jerry H. Lillie, both of Conneaut, Ohio

[73] Assignee: Plycraft Fabricating Corporation, Conneaut, Ohio

[21] Appl. No.: 470,064

[22] Filed: Feb. 28, 1983

[51] Int. Cl.[3] ..... E06B 7/16

[52] U.S. Cl. ..... 49/485; 49/495

[58] Field of Search ..... 49/475–479, 49/485–495; 428/7, 99

[56] References Cited

U.S. PATENT DOCUMENTS

| | | | |
|---|---|---|---|
| 294,267 | 2/1884 | Potter et al. | 49/495 X |
| 2,122,608 | 7/1938 | Harlow | 49/485 X |
| 3,216,164 | 11/1965 | Stillman | 428/157 |
| 3,761,347 | 9/1973 | Yackiw | 49/479 X |
| 4,115,973 | 9/1978 | Anderson | 49/463 X |

*Primary Examiner*—Henry F. Epstein

*Attorney, Agent, or Firm*—Maky, Renner, Otto & Boisselle

[57] ABSTRACT

A garage door weather seal for use on a garage having a door with a planar outside surface and a door frame including a surface normal to the plane of the garage door when closed. The seal comprises a main body portion which lies in a plane extending at an angle to both the door and door frame surfaces when installed. Sealing lips integrally molded to opposite edges of the main body portion form a weather-tight seal with both the surface of the garage door and the surface of the door frame. An L-shape leg structure connected with the main body portion serves to position the weather seal with respect to the door frame. The leg structure has two legs which deflect slightly to grip two surfaces of the door frame, one the above-mentioned surface and another normal thereto. One of the legs may have apertures for fasteners to hold the seal in place.

14 Claims, 4 Drawing Figures

GARAGE DOOR WEATHER SEAL

BACKGROUND OF THE INVENTION

The present invention relates to a weather seal for use in sealing the gap between the perimeter of a garage door and its door frame.

Frequently it is desirable to seal the gap between a garage door and its door frame. This is especially so where the garage is heated, or where the space above the garage is heated. Sealing may also be desirable where the garage is used as a workplace. However. the design of a seal for these purposes is complicated by the fact that with overhead garage doors, the spacing between the door frame and the door may vary from installation to installation. With segmented overhead garage doors which are mounted on tracks, there is the additional possibility of variation between the panels or segments of any one door. Therefore, the sealing portion of an effective seal must be able to accommodate some variation in the location of the door surface against which it seals. Additionally, it is desirable to provide a seal which, upon installation, forms a permanent, tight seal with a door frame. It is also desirable to provide a seal attached by fasteners which are themselves protected from the weather.

SUMMARY OF THE INVENTION

The present invention provides a new and improved seal for a garage door which bridges the gap between the perimeter of an overhead garage door and the surrounding door frame. The seal includes a planar main body portion which extends obliquely to both the plane of the garage door and a plane defined by the door frame perpendicular to the garage door. A pair of flexible lips form extensions of each edge of the main body portion, one lip sealingly engaging the door frame, and the other lip, being longer than the first mentioned lip, engaging the exterior surface of the garage door. The other lip extends from the main body portion essentially coplanar therewith a distance sufficient to accommodate variations in the gap between the garage door and door frame.

A generally L-shape leg sturcture integrally molded with the main body portion serves to position the seal on the door frame and may be provided with openings for fasteners to secure the seal in place. The leg structure desirably extends the full length of the main body portion and includes two legs, one of which is connected to the main body portion to extend normal to the plane of the garage door, and the other is intended to abut a similarly situated surface of the door frame or door jam. The first leg and main body form an acute angle, and the lip that seals against the door frame extends from the apex thereof. When the seal is in place, the first leg extends from this apex rearwardly toward the garage door.

The second leg is connected with the first leg at the rearmost edge of the first leg and is intended to engage a surface of the door frame which is parallel with the garage door. As initially formed, the second leg preferably makes an angle of about 85° with the first leg. However, upon installation, when the two legs are pressed against normal surfaces of the door frame or door jam, the angle between the legs increases to approximately 90°. Because the leg structure is made of a relatively stiff, but not rigid material, the legs undergo elastic deformation, but do not yield, during installation.

Therefore, the legs apply a continuing force to hold the apex where the leg structure joins the main body portion and the lip there attached firmly against the garage door frame. Plural openings may be provided at suitable intervals along the length of the second leg for fasteners such as nails or screws to hold the seal in place.

In a preferred embodiment, the main body portion and supporting leg structure are integrally formed of rigid PVC while the lips are made of a flexible PVC integral with the main body portion.

The invention, then, comprises the features hereinafter described and particularly pointed out in the claims, the following description and annexed drawing setting forth in detail a certain illustrative embodiment of the invention, this being indicative, however, of but one of the various ways in which the principles of the invention may be carried out.

BREIF DESCRIPTION OF THE DRAWINGS

DESCRIPTION OF PREFERRED EMBODIMENT OF THE INVENTION

Figure 2:
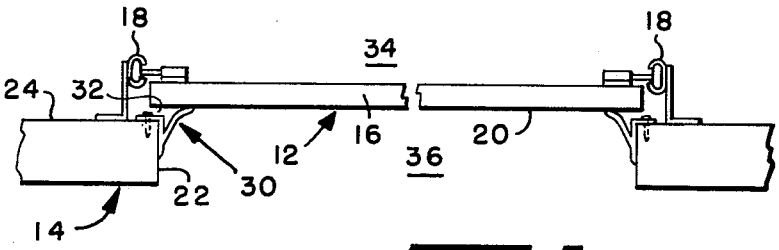
FIG. 2 is a plan view of a garage door and garage door frame equipped with such weather seal.
Figure 1:
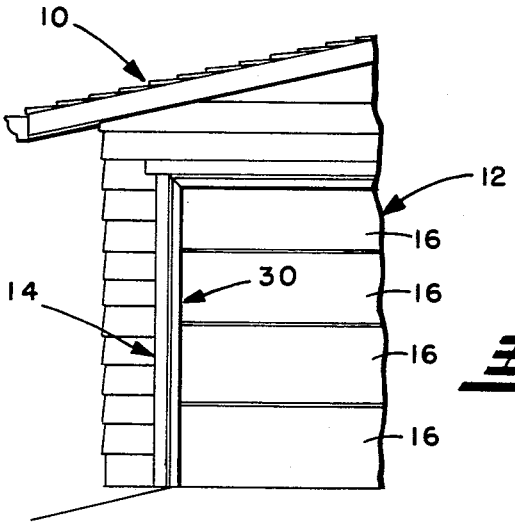
FIG. 1 illustrates a portion of a garage having a door frame and garage door and equipped with a weather seal in accordance with the present invention.

FIG. 1 illustrates a garage 10 having an overhead garage door 12 fitted in a door frame 14. The door 12 is a conventional overhead garage door which may be segmented into a plurality of panels 16 which run in tracks 18 (FIG. 2). When the door 12 is closed, its outside surface 20 generally defines a vertical plane. The door frame 14 is conventionally made of wood and includes a surface 22 which is substantially perpendicular to the plane defined by the outside surface 20 of the door 12 and a surface 24 which is parallel to the plane of the door. Although the present invention will be described with respect to a segmented overhead garage door 12, it will be appreciated that the weather seal 30 of the present invention is also suitable for use with other types of doors.

The garage 10 (FIG. 1) is equipped with such a weather seal 30 around the perimeter of the door frame 14. When the door is closed, the weather seal 30 spans the gap 32 (FIG. 2) between the door 12 and the door frame 14 to prevent air flow between the interior 34 of the garage and the exterior 36. Although the weather seal 30 will be described with respect to one side of the door frame 14 (the left side as viewed in FIG. 1), it will be understood that the weather seal is also applied across the top of the door frame and along the other side (i.e. the right side) of the door frame.

Figure 3:
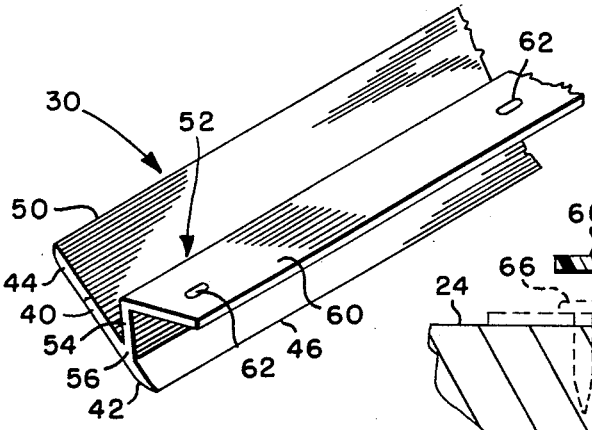
FIG. 3 is an enlarged perspective illustration of a length of weather seal constructed in accordance with the present invention.
Figure 4:
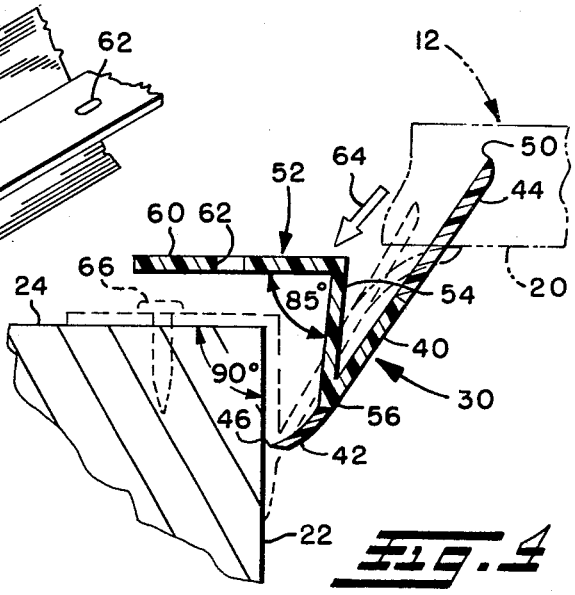
FIG. 4 is an enlarged sectional view showing the weather seal in solid lines in its initial undeformed configuration prior to installation and in phantom lines in its deformed configuration after installation.

The weather seal 30 is illustrated in greater detail in FIGS. 3 and 4. The weather seal 30 includes a main body portion 40 which is disposed obliquely to both surfaces 22 and 24 of the door frame 14. Therefore, the main body portion 40 is also oblique to the plane of the front or outside surface 20 of the garage door 12 when closed. The main body portion 40 is generally planar, and is desirably formed of rigid PVC. When the weather seal 30 is installed, the main body portion 40 lies in a plane which angularly intersects both planes defined by surfaces 20 and 22.

Along opposite axially extending edges of the main body portion 40 are a pair of sealing lips 42 and 44. The lips 42 and 44 are formed of a flexible PVC and are desirably integrally molded to the main body portion 40 and generally form extensions thereof.

The lip 42 at the outer end of the main body portion 40 is the shorter of the two lips 42 and 44 and is adapted to engage the surface 22 of the door frame. As initially formed, the lip 42 has a slight curve toward the surface 22. When the weather seal 30 is installed, the initial curve of lip 42 is flattened out as shown in phantom in FIG. 4, but the initial curve tends to maintain a constant sealing pressure between the feathered edge 36 of the lip 42 and the surface 22 of the door frame.

The lip 44 extends away from the main body portion 40 in a direction opposite from the shorter lip 42 and has a tip 50 at its distal end which is adapted to sealingly engage the outside surface 20 of the garage door 12 when closed. When the garage door 12 is open, the lip 44 extends in a direction generally coplanar with the main body portion 40 and at an angle of about 30° to the surface 22 of the door frame 14. However, when the garage door 12 is closed, the tip 50 of the lip 44 is deflected as it bears against the outside surface 20 of the garage door 12. Because the lip 44 is made of a resilient material, it can accommodate by varying amounts of deflection variations in the size of the gap 32 between door frame 14 and the front surface 20 of the garage door 12.

A generally L-shape leg structure 52 is connected with the main body portion 40 and is used to position and fasten the weather seal 30 in place. The leg structure 52 is desirably integrally formed with the main body portion 40 and is also made of rigid PVC. As shown, the leg structure 52 includes a first leg 54 which extends the full length of the main body portion 40. The first leg 54 is generally planar and is joined with the main body portion 40 where the lip 42 is joined to the main body and so forms an apex 56 along that line, forming an acute angle with the main body portion. The angle between the first leg 54 and main body portion 40 is desirably approximately 30°. The first leg 54 is adapted to abut surface 22 of the door frame 14 upon installation of the weather seal 30, as shown in phantom in FIG. 4.

The leg structure 52 also includes a second leg 60. The second leg 60 is generally planar and extends the full length of the first leg 54 and is joined therewith to form an angle therebetween preferably of about 85°. The second leg 60 extends from the first leg 54 in a direction away from the main body portion 40, and may include a plurality of spaced apart openings 62 for fasteners such as nails and screws to fasten the weather seal 30 to the door frame 14 with the second leg 60 abuttingly engaging surface 24 of the door frame 14.

During installation of the weather seal 30, the leg structure is pressed against the door frame at an angle such as indicated by arrow 64. Since the surfaces 22 and 24 of the door frame are substantially perpendicular to each other, and since the legs 54 and 60 are initially at an angle of about 85° to each other, force applied in the direction of arrow 64 causes the legs to deflect slightly until the legs firmly abut the surfaces 22 and 24 of the door frame. The PVC of which the main body portion 40 and the leg structure 52 are formed is substantially more rigid than the lips 42 and 44, yet still flexible enough that when the legs 54 and 60 are pressed against the corner of the door frame, the legs are deflected elastically from their initial 85° orientation to approximately 90°. The weather seal 30 is held firmly against the surfaces 22 and 24 of the door frame while suitable fasteners such as the nails 66 (FIG. 4) are used to secure it in place. Since the legs 54 and 60 undergo some elastic deformation with little or no yielding, the legs tend to grip the surfaces 22 and 24 of the door frame 14 thereby applying a force which presses the apex 56 firmly against the surface 22 of the door frame 14.

The leg structure 52 is located entirely "inside" the weather seal 30. This is to say that when the garage door 12 is closed, the weather seal 30 totally protects the leg structure from the weather. This means that the fasteners 66 (FIG. 4) are protected from rust or corrosion which might otherwise occur if they were exposed. Moreover, the second leg 60 abuts a surface 24 which is readily accessible from the interior of the garage, which facilitates installation of the seal 30.

It should be noted that although the weather seal 30 has been described as being installed directly on the door frame 14, it can also be easily installed in garages where a door jam or stop is fastened to the door frame. In this case, the seal 30 would be pressed against surfaces on the door jam which are parallel to the surfaces 22 and 24 of the door frame 14. Additionally, it will be appreciated that the surfaces 22 and 24 are only nominally perpendicular to each other. Commercial grades of lumber may deviate slightly from the ideal. Further, the outer surface 20 of the garage door 12 is only nominally normal to the plane 22 of the door frame. Also, during construction of the garage, it may happen that the orientation of the door frame deviates slightly from the ideal. Nevertheless, it should be understood that the terms perpendicular, parallel and their equivalents as used in this specification and the appended claims are intended to encompass such deviations, and that the weather seal 30 of the present invention is sufficiently resilient to accommodate these variations.

Although the seal dimensions may be varied depending on the particular installation, it has been found that a seal having the following dimensions can be effectively used for most installations; a main body portion 40 having a length of approximately ½ inch, a lip 42 having a length of approximately ¼ inch, a lip 44 having a length of approximately ⅝ inch, a first leg 54 having a length of approximately 9/16 inch and a second leg having a length of approximately 13/16 inch. All parts also may have a nominal thickness of approximately 1/16 inch. Moreover, the seal may be made in various lengths, for example, 7 feet, 8 feet and 9 feet lengths and either cut to length or spliced together at the job site depending on the particular installation requirements.

It should be noted that the main body portion 40 normally should not extend beyond the plane of the second leg 60 to make certain that the main body portion does not interfere with the closing of the door. Also, the lip 44 should extend beyond the plane of the second leg 60 a sufficent distance, for example, ⅜ inch, to ensure that the second lip sealingly engages the garage door surface 20 when the door is closed.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

The embodiments of the invention in which an exclusive property or privilege is claimed are defined as follows:

1. A weather seal for a garage door, said seal having a main body portion and a generally L-shape attachment means for attaching said seal to a garage door frame, said L-shape attachment means including first and second legs connected with each other and engageable with surfaces of a frame of a garage door which surfaces are generally normal to each other, said main body portion extending outwardly from said first leg at an included angle of less than 90°, and a first sealing lip on the outer edge of said main body portion adapted to form a weather-tight seal with the garage door when closed.

2. A seal as set forth in claim 1 wherein said included angle between said main body portion and said first leg is approximately 30°.

3. A seal as set forth in claim 1 further comprising a second sealing lip adapted to form a weather-tight seal with the door frame.

4. A seal as set forth in claim 3 wherein said second sealing lip in on the opposite edge of said main body portion and extends inwardly of said first leg.

5. A seal as set forth in claim 4 wherein said second sealing lip is shorter than said first lip and is adapted to engage one surface of the garage door frame.

6. A seal as set forth in claim 5 wherein said second sealing lip has a slight curve toward such one surface.

7. A seal as set forth in claim 4 wherein said sealing lips are formed of resilient material and said main body portion is formed of a relatively rigid material, and said sealing lips are integrally molded to opposite ends of said main body portion.

8. A seal as set forth in claim 1 wherein said first and second legs are formed to include an angle of less than 90° and are deflectable to engage surfaces of the garage door frame which are normal to each other.

9. A seal as set forth in claim 8 wherein the included angle between said first and second legs is approximately 85°.

10. A seal as set forth in claim 1 wherein said main body portion is connected with one end of said first leg and said second leg is connected with and transverse to the other end of said first leg.

11. A seal as set forth in claim 10 wherein said second leg includes a plurality of openings for insertion of fasteners to secure said seal to such surface.

12. A seal as set forth in claim 4 wherein said main body portion is connected with one end of said first leg and said second leg is connected to the other end of said first leg and transverse to said first leg, and said first sealing lip extends outwardly beyond the plane of said second leg.

13. A seal as set forth in claim 4 wherein said first and second legs and said main body portion are formed of a relatively stiff polymeric material and said sealing lips are formed of a relatively flexible polymeric material.

14. A seal as set forth in claim 13 wherein said relatively stiff material is rigid PVC and said relatively flexible material is flexible PVC.

* * * * *